US005796048A

United States Patent [19]

Suzuki et al.

[11] Patent Number: 5,796,048

[45] Date of Patent: Aug. 18, 1998

[54] INSULATOR HAVING CONDUCTIVE SURFACE COATING TO PREVENT CORONA DISCHARGE

[75] Inventors: Yoshihiro Suzuki, Okazaki; Eiji Kutsuna, Aichi; Hiroshi Nozaki, Nagoya; Shigeo Mori, Kuwana, all of Japan

[73] Assignee: NGK Insulators, Ltd., Japan

[21] Appl. No.: 553,417

[22] PCT Filed: Mar. 28, 1995

[86] PCT No.: PCT/JP95/00574

§ 371 Date: Nov. 22, 1995

§ 102(e) Date: Nov. 22, 1995

[87] PCT Pub. No.: WO95/26560

PCT Pub. Date: Oct. 5, 1995

[30] Foreign Application Priority Data

Mar. 28, 1994 [JP] Japan ..... 6-057761

[51] Int. Cl.[6] ..... H01B 17/48

[52] U.S. Cl. ..... 174/141 C; 174/137 A

[58] Field of Search ..... 174/140 R, 140 C, 174/189, 182, 179, 141 R, 141 C, 137 A, 137 B, 138 C

[56] References Cited

U.S. PATENT DOCUMENTS

| | | | |
|---|---|---|---|
| 1,997,688 | 4/1935 | Hunt et al. | 174/174 C |
| 2,281,173 | 4/1942 | Santomieri | 428/209 |
| 2,287,976 | 6/1942 | Croskey et al. | 174/209 |
| 2,383,090 | 8/1945 | Torok | 174/182 |
| 3,024,303 | 3/1962 | Smothers et al. | 174/189 |
| 3,368,026 | 2/1968 | Vince | 174/140 C |
| 3,658,583 | 4/1972 | Ogawa et al. | 427/126.2 |
| 3,836,705 | 9/1974 | Rosenblatt | 174/140 C |
| 4,443,659 | 4/1984 | Tatem | 174/140 C |
| 4,465,900 | 8/1984 | Mitsumatsu et al. | 174/209 |
| 4,524,404 | 6/1985 | Verma | 361/132 |
| 4,658,092 | 4/1987 | Nakamura et al. | 174/182 |
| 4,782,199 | 11/1988 | Seike et al. | 174/189 |

FOREIGN PATENT DOCUMENTS

| | | | |
|---|---|---|---|
| 53-146197 | 12/1978 | Japan | H01B 17/50 |

*Primary Examiner*—Kristine L. Kincaid
*Assistant Examiner*—Kamand Cuneo
*Attorney, Agent, or Firm*—Parkhurst & Wendel

[57] ABSTRACT

An insulator including an insulator body, a metal fitting secured to the insulator body via cement material, a conductive layer provided on the insulator body, the conductive layer including a first exposed portion and a second portion embedded in the cement material, and a conductive covering film provided on the second portion of the conductive layer. A conductive grain layer is on the second portion of the conductive layer and is covered by the conductive covering film. According to the present invention, the conductive covering film is more flexible than the second portion of the conductive layer. The present insulator has a simple construction, is easy to produce, and assures continued electrical conduction through the cement material over time.

15 Claims, 8 Drawing Sheets

| | 69kv class SP insulator |
|---|---|
| a | 95 (mm) |
| b | 98 (mm) |
| c | 96.5 (mm) |
| d | 104 (mm) |
| e | 107 (mm) |
| f | 48 (mm) |
| g | 5 (mm) |
| h | 43 (mm) |
| i | 110 (mm) |
| j | 261 (cm) |
| k | 146 (cm) |
| z | 401 (cm) |

INSULATOR HAVING CONDUCTIVE SURFACE COATING TO PREVENT CORONA DISCHARGE

APPLICABLE FIELD

The present invention relates to insulators with conductive coatings to be used for supporting wires or in interrupting devices. More specifically, the invention relates to insulators conductive coatings in which a metal fitting is joined to an insulator body with a cement material having high electric resistance, such as Portland cement. The insulator body has an electrically conductive coating that is electrically connected to the metal fitting.

BACKGROUND TECHNIQUE

When corona discharge occurs due to a stained surface of an insulator or the like, surrounding radios or televisions suffer noise troubles. In order to prevent such a phenomenon, insulators with conductive coatings. To the surface of the insulator, which is made of porcelain, is applied a glaze having conductivity (hereinafter referred to as conductive glaze), and a conductive means is provided between the metal fitting and the conductive glaze layer so that a given amount of electric current may flow between the metal fitting and the conductive glaze layer. In order to secure this electrical contact various constructions have been proposed up to now. In the following, an example of such a conductive means employed at a base portion of a station post insulator (a rod-shaped insulator) will be explained.

For example, a prior art structure as shown in FIG. 11 is known in which an insulator body and a metal fitting are electrically connected to each other by using a metal spraying method. More specifically, a conductive glaze layer 31 is formed on the outer peripheral surface of the porcelain body 30, and the metal fitting 33 is fixed to an end of the porcelain body 30 via the conductive glaze layer 31 and a cement material 32. A conductive metal 34 is sprayed onto the surfaces of the conductive glaze layer 31, an end of the cement material 32 and the metal fitting 33 so that the conductive glaze layer 31 and the metal fitting 33 may be electrically connected. In the figure, reference numerals 35 and 36 denote insulating sand and an insulating film, respectively.

Further, a prior art structure as shown in FIG. 12 is known as an example using a metal-connecting method. More specifically, a conductive paint 38 is applied onto an end face of a porcelain body 30 and a conductive glaze layer 31 provided with a sand portion, and the conductive paint 38 and the metal fitting 33 are electrically connected to each other by connecting them with a conductive metal 39. In this case, a coil spring is used as the conductive metal 39.

Furthermore, although not shown, a structure is known that is formed by a conductive cementing method in which a conductive material such as carbon is mixed into a cement material between a porcelain body and a metal fitting so as to ensure electrical connection between the porcelain body and the metal fitting.

However, in the metal spraying process shown in FIG. 11, a Metallikon material (94 wt % Pb, 5 wt % Sb, and 1 wt % remainder) is ordinarily employed as the conductive metal 34. Accordingly, it is feared that a worker may suffer from a disease caused by lead (Pb) due to handling the Metallikon material during the production of insulators. Further, in order to prevent corrosion of the surface of metal 34 through exposure to air, a corrosion-preventing film 40 is applied after spraying the metal. As mentioned above, there are additional steps of spraying the conductive metal 34 and applying the corrosive-preventing film 40 in the producing process, which raises the production cost together with costs of the conductive metallic material such as the Metallikon material and the corrosion-preventing film.

In the metal connecting method shown in FIG. 12, the metal 39 is likely to be corroded with moisture possessed by the cement material 32, and there is a high possibility that conductivity is reduced due to the corrosion. As shown in FIG. 12, a sponge 41 is arranged to absorb the moisture from the cement 32, and a conductive paint 38 is applied to the surfaces of the porcelain 30 and the conductive glaze layer 31 so as to make the metal 39 and the conductive glaze layer 31 electrically connected to each other through exposure of a part of the metal. This makes the construction complicated, and makes it difficult to assemble the insulator with conductive coating during the production thereof.

In the conductive cementing method, since carbon is mixed into the cement material, total strength of the cement decreases, thereby reducing mechanical strength of the insulator. Further, when carbon is mixed into the cement material, the ratio of water to the cement material needs to be set greater. Consequently, the above strength of the cement material further decreases. In addition, since the cement material contains a large amount of water, the drying shrinkage factor becomes greater so that the fitting strength of the metal fitting is reduced. Moreover, carbon mixed into the cement material sets up an electrical potential on the zinc-plated layer on the surface of the metal fitting buried in the cement material. As a result, the metal fitting is corroded (due to galvanic corrosion), and the porcelain is cracked due to stress resulting from the incident increase in volume of the metal fitting due to corrosion thereof.

As mentioned above, the above conducting methods possess various serious problems. Under the circumstances, in order to solve these problems, a prior art method has been considered for attaining conduction by using the cement material having a high electric resistance. That is, the conductive glaze and the metal fitting are electrically connected to each other by utilizing the electric conductivity owing to the moisture in dry-wet equilibrium of, for example, the Portland cement material (20–22 wt % $SiO_2$, 3–4 wt % $Fe_2O_5$, 1–2 wt % $SO_3$, 4–7 wt % $Al_2O_3$, and 60–65 wt % CaO).

However, if the dried degree of the Portland cement material increases, the cement material shrinks. Consequently, slippage occurs between the cement material and the conductive glaze layer on the surface of the insulator. Accordingly, a microscopic gap is formed between the cement material and the conductive glaze layer. On account of this, a large potential difference is formed between the end portion of the cement and the opposed conductive glaze layer, so that extremely large corona discharge occurs between them. The occurrence of the corona discharge damages the essential function of the conductive insulator.

For this reason, a method has not been practically available to replace the conventional techniques with respect to the conducting method using the Portland cement material.

DISCLOSURE OF THE INVENTION

The present invention has been accomplished under consideration of the problems possessed by the prior art. Therefore, the object of the present invention is to provide a insulator which has a simplified structure, can be simply and easily produced, and can ensure the conductivity of the cement material having a high electric resistance at a practically employable level without risking poisoning the workers that are exposed to the cement.

Further, it is another object of the present invention to provide an insulator with conductive coating which can prevent occurrence of corrosion through a chemical reaction between the surface of the metallic fitting and cement during curing of the cement.

It is a further object of the present invention to provide a an insulator with conductive coating strength that exhibits electric conductivity even if the strength of the insulator cannot be maintained due to differences in coefficients of thermal expansion between the insulator body and the conductive glaze layer formed on the peripheral surface of the insulator body.

In order to accomplish the above objects, the insulator according to the present invention is characterized by comprising an insulator body, and a metal fitting fitted to the insulator body via a cement material having high electric resistance, wherein an outer surface portion of the insulator body exposed outside is covered with a first conductive layer, a second conductive layer is provided on at least a part of a surface portion of the insulator body buried in the cement material, a conductive film being more flexible than the second conductive layer is formed on the second conductive layer to cover the said surface of the second conductive layer, and the first conductive layer is in electrical contact with the second conductive layer.

Since the conductive film being softer or more flexible than the second conductive layer is formed on the second conductive layer, concentration of shrinking stress and mechanical stress of the cement material having high electric resistance upon the conductive layer and the sand layer buried in the cement material can be mitigated. Further, the formation of a fine gap between the Portland cement and the conductive glaze layer on the surface of the insulator due to slippage between them following drying shrinkage of the Portland cement can be prevented so that the electric contact between them can be ensured and occurrence of corona discharge can be prevented.

BEST MODE FOR PRACTICING THE PRESENT INVENTION

Figure 1:
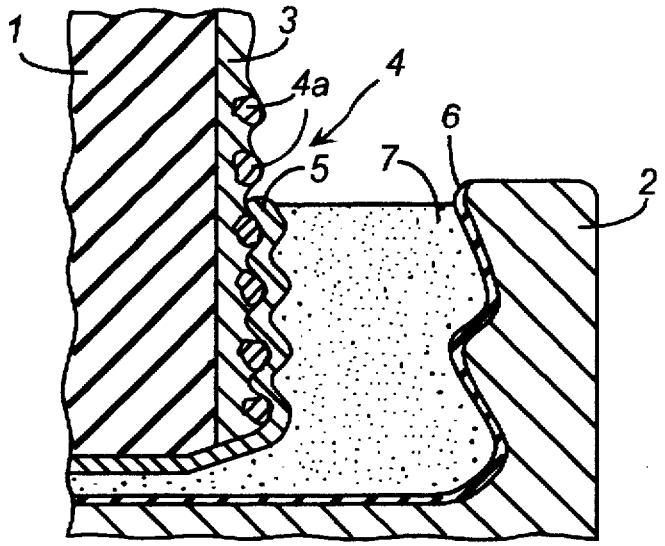
FIG. 1 is a sectional view illustrating a base portion of a station post insulator as a first embodiment.

To include the following features in addition to the above-mentioned ones of the present invention is recited as preferred embodiment of the present invention. So long as no contradiction occurs, a insulator obtained by selectively combining the below-mentioned features (1)–(15) is recited as a preferred embodiment of the present invention.

(1) A sand portion is provided on the second conductive layer, and the second conductive layer and the sand portion are covered with the conductive film. By so doing, the sand portion increases tensile strength between the insulator body and the metal fitting so that the mechanical strength of the conductive insulator can be enhanced.

(2) The sand portion is made of sand grains, which are covered with the conductive film. By so doing, the conductivity at the surface of a portion of the insulator body buried in the cement material is continuously secured, so that the conductivity of the entire insulator is enhanced.

(3) The above second conductive layer is provided at least near a surface portion of the cement material exposed outside. Since water drops, stains, etc. are likely to be attached to the location where the cement material is exposed outside, electric current is likely to flow between the conductive layer on the insulator body and the metal via such water drops, stains, etc. As a result, the conductive layer is likely to be damaged at this location. However, when the second conductive layer is provided at least near the surface portion of the cement material exposed outside, the conductive layer is protected by the second conductive film to prevent damage of the conductive layer.

(4) The above second conductive layer is provided around at least the substantially entire lateral surface a portion of the insulator body buried in the cement material. By so doing, the insulator body and the metal fitting are electrically connected to each other at least via the substantially entire lateral surface of that portion of the insulator body buried in the above cement material, the conductivity of the entire insulator can be enhanced.

(5) The above conductive film has antialkaline properties. Since the cement material contains alkaline ions, the durability of the conductive film and in turn that of the layer and the conductive insulator can be enhanced by imparting anti-alkaline properties upon the conductive film.

(6) An insulating film is formed on the surface of the metal fitting buried in the cement material. By so doing, occurrence of corrosion through a chemical reaction between the surface of the metal fitting and the cement during curing the cement can be prevented, thereby preventing the degradation of the metal fitting. As mentioned later, the thickness of the insulating film is preferably not more than 20 μm. By so doing, the insulating film allows current flow, enhanced by electrostatic coupling.

(7) A head and a recess are formed on the insulator body, and the above metal fitting includes a cap-shaped metal fitting attached around the head and a pin-shaped metal fitting attached into the recess. The present invention is advantageously suited for conductive insulators, such as a suspension insulator, having this structure.

(8) An insulating glaze layer is provided on a surface of the above head portion of the insulator body buried in the cement material and the above second conductive layer, the surface of the head portion being formed with no second conductive layer. Since the insulating glaze layer has a coefficient of thermal expansion smaller than the insulator body, compression force is applied to the surface of the insulator body by the insulating glaze layer. Thereby, a specific strength of the insulator can be maintained. As mentioned later, the coefficient of thermal expansion of the insulating layer is preferably smaller than that of the insulator body by 0.1 to 0.15%.

(9) A conductive film is formed on the surface of the above insulating glaze layer, and the conductive film covers the insulating glaze layer and is electrically connected with to the second conductive layer. By so doing, the strength of the insulator can be maintained by the insulating glaze layer and the conductivity can be enhanced by the conductive film.

(10) The above head is cylindrical, a straight portion is formed at an inner periphery of a lower end portion of the above cap metal fitting such that the straight portion extends substantially in parallel to the outer periphery of the insulator body, and a conductive grain layer is formed on a surface of the insulator body opposed to the straight portion. By so doing, the density of electric current in a portion of the metal fitting 14, which is likely to suffer concentration of electric current and near the surface of cement, can be reduced, so that corona discharge can be effectively prevented. Further, since the straight portion 20 of the cap metal fitting extends in parallel to the cylindrical face of the insulator body, stress due to a mechanical load on the insulator body does not concentrate on the conductive glaze grain layer. Therefore, reduction in mechanical strength of the insulator can be prevented, so that strength of the insulator can be maintained. As mentioned later, it is preferable to form a conductive grain layer at an interface portion between the inner peripheral surface of the insulator body and the cement material. By so doing, the electric field at the portion where electric current is likely to be concentrated can be mitigated to prevent occurrence of the corona discharge.

(11) The resistivity of the surface of the conductive film is made smaller than that of the conductive layer on the insulating body. By so doing, the electric current entering the conductive covering film is dispersed and spread faster in the conductive covering film than in the conductive layer. Consequently, the concentration of electric current can be reduced, and the electric field between the metal fitting and the conductive covering film can be mitigated. As a result, the conductivity between the conductive layer on the insulator body and the metal fitting can be enhanced.

(12) The resistivity of the surface of the above conductive layer is set at 15–50MΩ, and those of the conductive grain layer and the conductive covering film are set at 0.5–3MΩ and not more than 10KΩ, respectively. By so doing, reduction in the concentration of electric current and in density of the electric current and prevention of the corona discharge near the surface of the cement can be effectively realized in the preferable structure described above in section (10).

(13) The above insulator is a rod-shaped insulator. The present invention is advantageously suited for the insulator such as the rod-shaped insulator having such a structure. The "rod-shaped insulator" here means the station post, the line post, and the long size insulator.

(14) In the rod-shaped insulator, the resistivity of the surface of the above conductive layer is set at 10–30MΩ, and those of the conductive grain layer and the conductive covering film are set at 0.5–3MΩ and not more than 10KΩ, respectively. By so doing, the functions and the effects mentioned in above in section (11) can be realized in the rod-shaped insulator.

(15) The metal fitting has an end portion-closed structure, and an insulating layer is provided on a surface of the end portion of the insulator body corresponding to the closed end portion of the metal fitting. When a conductive covering film is applied to the surface of the insulator body corresponding to the closed end portion of the metal fitting, there is the possibility that the insulating film on the surface of the metal fitting is broken through rubbing between the metal fitting and the surface of the conductive covering film on the insulator body during assembling. In such a case, an electric potential may develop between the conductive material in the conductive covering layer and the surface of the metal fitting, so that the metal fitting rusts (oxidizes). Such a phenomenon can be avoided by providing the insulating layer upon the surface of the end portion of the insulator body corresponding to the closed end portion of the metal fitting. Instead of the insulating layer, an insulating member may be arranged between the closed end portion of the metal fitting and the surface of the insulator body corresponding to the closed end portion of the metal fitting.

Next, more specific embodiments of the present invention will be explained.

In the following, a first embodiment in which the insulator of the present invention is embodied in an entirely conductive station post insulator will be explained with reference to FIGS. 1 to 6 considering a base portion by way of example.

A plurality of annular shed portions are integrally formed at plural stages around the outer peripheral surface of a columnar insulator body 1 made of porcelain, and metal fittings 2 are attached to opposite ends of the insulator body 1 to constitute the insulator as a whole.

A conductive glaze layer 3 is formed around the entire peripheral surface of the insulator body 1 excluding opposite end surfaces. Around the outer peripheral surface of the end portion of the insulator body 1 is formed a sand portion 4 made of numerous conductive glaze grains 4*a*. The conductive glaze grains 4*a* are formed by applying a conductive glaze material onto the outer peripheral surface of the individual sand grains. In this way, electrical contact is secured at the surface of the insulator body 1 covered with the sand portion 4 and the conductive glaze layer 3. The resistivity of the surface of the insulator body 1 covered by glaze layer 3 is set at not more than 30MΩ, and that of the surface of the sand grain is set at 3MΩ.

A conductive covering film 5 made of a soft conductive bituminous paint is formed, by coating, on the surface of the end portion of the insulator body 1 covered with the sand portion 4 and the conductive glaze layer 3 and the end face of the insulator body 1. The conductive bituminous paint is a paint using pitch, asphalt or the like as a vehicle, and contains carbon for imparting conductivity thereon.

To apply such a soft conductive covering film is to mitigate concentration of shrinking stress and mechanical stress of Portland cement 7 as the below-mentioned cement material having high electric resistance upon the sand portion, and to prevent concentration of the electric field by making electric current smoothly flow in or out through the conductive glaze layer 3 and prevent degradation of the conductive glaze layer 3. In this embodiment, the conductive covering film 5 has a surface resistivity of not more than 4KΩ and a thickness of 25 μm.

An insulating paint layer 6 of an insulating bituminous paint is formed as an insulating covering film on an inner side of the metal fitting 2 by spray coating. The layer on the inner side of the metal fitting 2 physically interrupts zinc in the surface of the metal fitting 2 from the cement 7 during curing the cement so that a chemical reaction between the cement 7 and the metal fitting 2 may be prevented. As such a bituminous paint, one known in the technical field in concern may be used.

This insulating paint layer 6 needs to permit flow of a given amount of current. If the covering film layer 6 has no pin holes, a small amount of current flows due to electrostatic coupling but no large amount of current can flow. Further, if the film thickness is not less than 50 μm, it is considered that electrostatic coupling conduction is interrupted and no conduction may be attained. Therefore, in order to enhance current flow, it is preferable that the layer 6 is less than 50 μm thick and as thin as possible, and has pin holes. In this embodiment, since the layer 6 is formed by spray coating the insulating bituminous paint as mentioned above, numerous pin holes (not shown) are formed.

In the above embodiment, the thickness of the layer 6 was about 5 μm. The metal fittings 2 are fixedly engaged with opposite end portions of the insulator body 1 by using Portland cement 7. The conductive paint layer 5 protrudes through the end face of the cement 7. The protrusion length of the layer 5 is preferably in a range of about 0.5 to 10 mm, more preferably 2 to 8 mm. The conductive covering film may directly contact the metal fitting along its inner bottom surface. In such a case, it is preferable to interpose an insulating spacer such as hard cork or resin between them.

The conductive structure of the above-mentioned insulator will be explained in detail.

Figure 3:
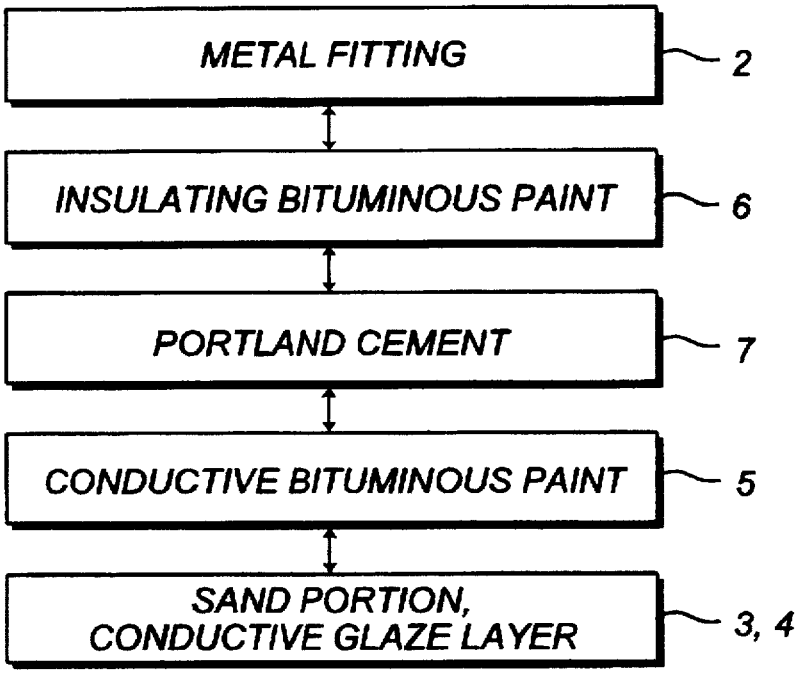
FIG. 3 is a block diagram showing a conductive structure of the instant embodiment.

As shown in FIG. 3, current from the free electron-conductive metal fitting 2, i.e. typical metal current conduction, is led to the free electron-conductive sand portion 4 and the conductive glaze layer 3 via the insulating paint layer 6 effecting ion current conduction and electrostatic coupling conduction (and very partially effecting insulating film-fracturing conduction), the ion current-conductive Portland cement 7 and the free electron-conductive conductive paint 5. On the other hand, current flows from the conductive glaze layer 3 in the reverse direction described above. The conductive paint layer (covering film) 5 is positioned between the sand portion 4 and the conductive glaze layer 3 and the Portland cement 7. Accordingly,since most of current flowing from the conductive glaze layer 3 and the sand portion 4 to the Portland cement 7 flows though the conductive film, the free electron conduction occurs to enhance conductive performance. The current flows to the other metal fitting 2 through the conductive glaze layer 3.

Next, the relationship between the resistance of the cement and the corona discharge characteristic was examined by using the conductive insulator of the above embodiment. In a voltage drop circuit shown in FIG. 2, a voltage drop across the cement was measured, which was converted to a resistance. In the measuring circuit, 25 is a transformer, and 26 and 27 are an ampere meter and a voltmeter, respectively.

Figure 4:
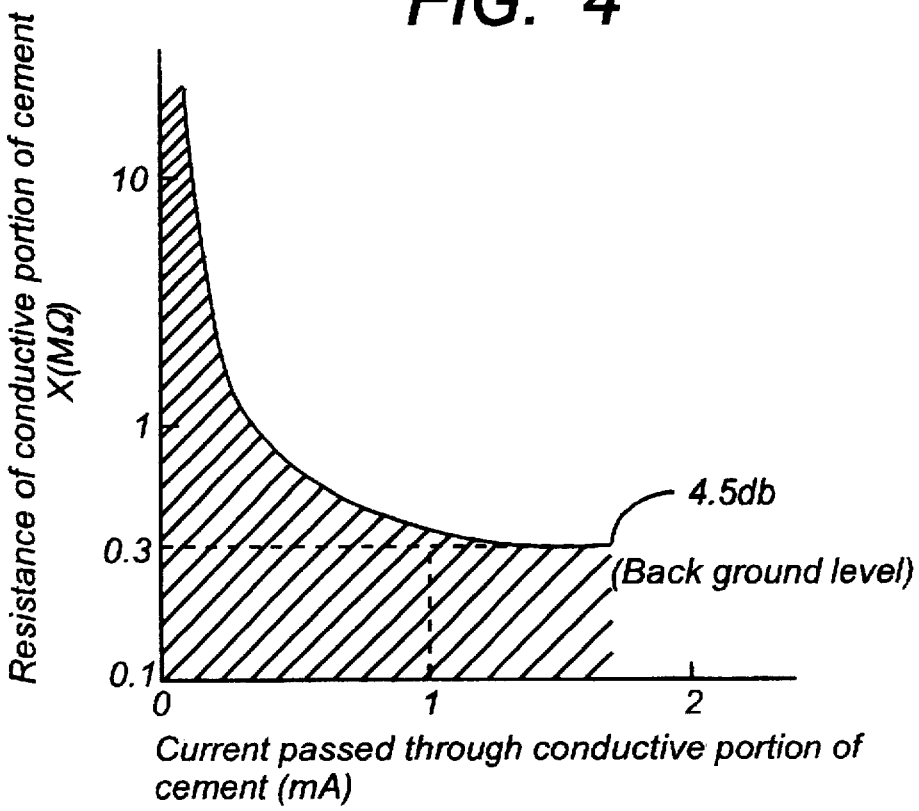
FIG. 4 is a graph showing the relationship between the resistance of a conducting portion and the corona characteristic of cement.

FIG. 4 is a graph showing the current flowing through the cement vs. the resistance of the cement at a noise level of −4.5 db due to the corona discharge. In the figure, the shadowed portion is an area where the noise level is not more than −4.5 db.

As a result, as shown in the graph of FIG. 4, the maximum permissible resistance of the cement of the insulator in this embodiment can be set at 0.3MΩ under an actual use environment, as described below. Since the resistance X of the above conductive portion is expressed by X=Y/Z in which Y is a volume resistivity of the cement and Z is an electrode coefficient (defined below), a range of weather conditions which satisfies the conductive portion resistance $X=Y/Z \leqq 0.3M\Omega$ can be an area to which the conductive insulator can be applied. When the insulator according to the present invention is employed in this range, the occurrence of the corona discharge can be suppressed to the background level of about −4.5 db so that the problem due to the corona discharge may be solved.

The electrode coefficient is set based on various dimensions of the insulator described below. In particular, the electrode coefficient Z is equal to A/l, where l=length of the conductor and A=area of the conductor. The electrode coefficient Z is utilized to calculate resistance R, where $R=\rho/Z$, $\rho$=resistivity.

Figure 2:
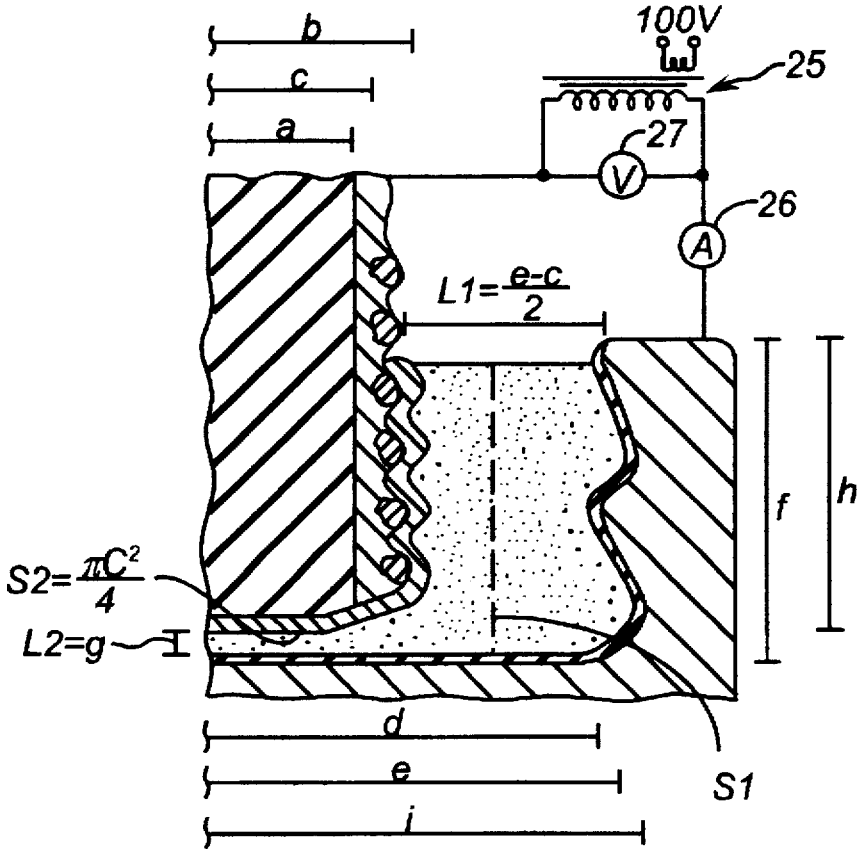
FIG. 2 is a schematic view showing various dimensions to set an electrode coefficient.

As shown in FIG. 2, a barrel diameter of the insulator body 1 is "a", a diameter of the insulator body 1 including the sand portion 4 "b", the inner diameter of the metal fitting "d", the depth of the metal fitting "f", and the maximum thickness of the upper cement "g".

The average diameter "c" of the insulator body 1 is $c=(a+b)/2$, the average inner diameter "e" of the metal fitting is $e=(d+i)/2$, and a depth "h" by which the side face cement portion is opposed to the electrode is $h=f-g$.

The average side face electrical contact area S1 is expressed by $S1=\pi((c+e)/2)h$. A distance L1 between the electrodes (insulator and metal fitting) is $L1=(e-c)/2$, and a side area coefficient "j" of the electrode coefficient Z is $j=S1/L1$.

The bottom electrical contact area "S2" of the end face electrode is $S2=\pi c2/4$, the distance "L2" between the electrodes is $L2=g$, and the bottom area coefficient "k" of the end face electrode is $k=S2/L2$.

Therefore, the total electrode coefficient "Z" of the present conductive insulator is expressed by $Z=j+k$.

Figures 5, 6:
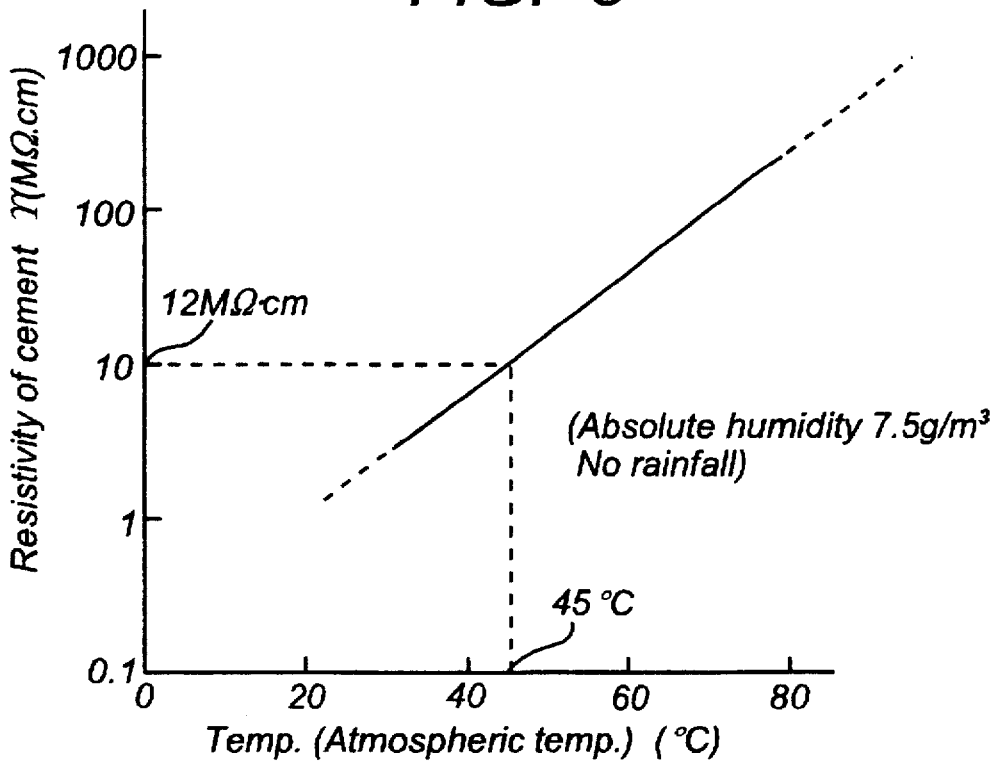
FIG. 5 is a graph showing the relationship between the volume specific resistance and the temperature of the cement.
FIG. 6 is a explanatory view giving various dimensions of 69 kv grade station post insulators.

The graph of FIG. 5 shows the relationship between the the volume resistivity of the Portland cement 7 in this embodiment in the dry/wet equilibrium condition. This was examined under the absolute humidity of 7.5 g/m$^3$ with no rainfall. For example, the desert region in Saudi Arabia is cited as a severe region in which the present insulators are to be actually used. Judging from the past data, the weather condition of this region is that the yearly average temperature is 25° C. and the absolute humidity is 10 g/m$^3$ with no rainfall. Therefore, it is sufficient to consider in view of the yearly average temperature of 20° C. that the temperature in the yearly average dry condition is 45° C. and the absolute humidity of 10 g/m$^3$. If this condition is applied to the graph in FIG. 5, it is seen that the volume resistivity of the cement under this dry condition is 12MΩ.cm or less. According to this graph, since the volume resistivity is 12MΩ.cm or less at the absolute humidity of 7.5 g/m$^3$, the volume resistivity is naturally not more than 12MΩ.cm at the wet condition of 10 g/m$^3$.

Assume that the insulator constructed above has various dimensions shown in the Table of FIG. 6 and is to be used as a conductive insulator to be used in a power transmission line of a 69 kV class. This 69 kV class insulator has a low coefficient of electrode. When these data are applied to the above mentioned equation to determine the coefficient of electrode, the coefficient of electrode of the conductive portion of the cement is Z=407 cm as shown in the Table. Therefore, the resistance of the conductive portion even in Saudi Arabia's weather conditions is Y/Z=12 (MΩ.cm)/407 (cm)=0.06 (MΩ)=X<0.3 (MΩ). From the above mentioned experiments, it is seen that if X=Y/Z≦0.3 (MΩ), the occurrence of the corona discharge can be suppressed.

That is to say, the Saudi Arabia's desert region which is a severe actual use region for the insulators falls in the region where the 69 kV class conductive station post insulators having a low coefficient of electrode can be used. In other words, according to the insulator of this embodiment, the surface of the insulator body 1 is covered with the conductive sand portion 4 and the conductive glaze layer 3, and then conductively covered with the conductive bituminous paint layer 5. Therefore, the conductive performance of the cement could be enhanced, and the conducting method with the Portland cement material could be practically used.

Next, a second embodiment in which the insulator according to the present invention is embodied in a suspension type insulator will be explained in detail with reference to FIGS. 7 and 8.

Figure 8:
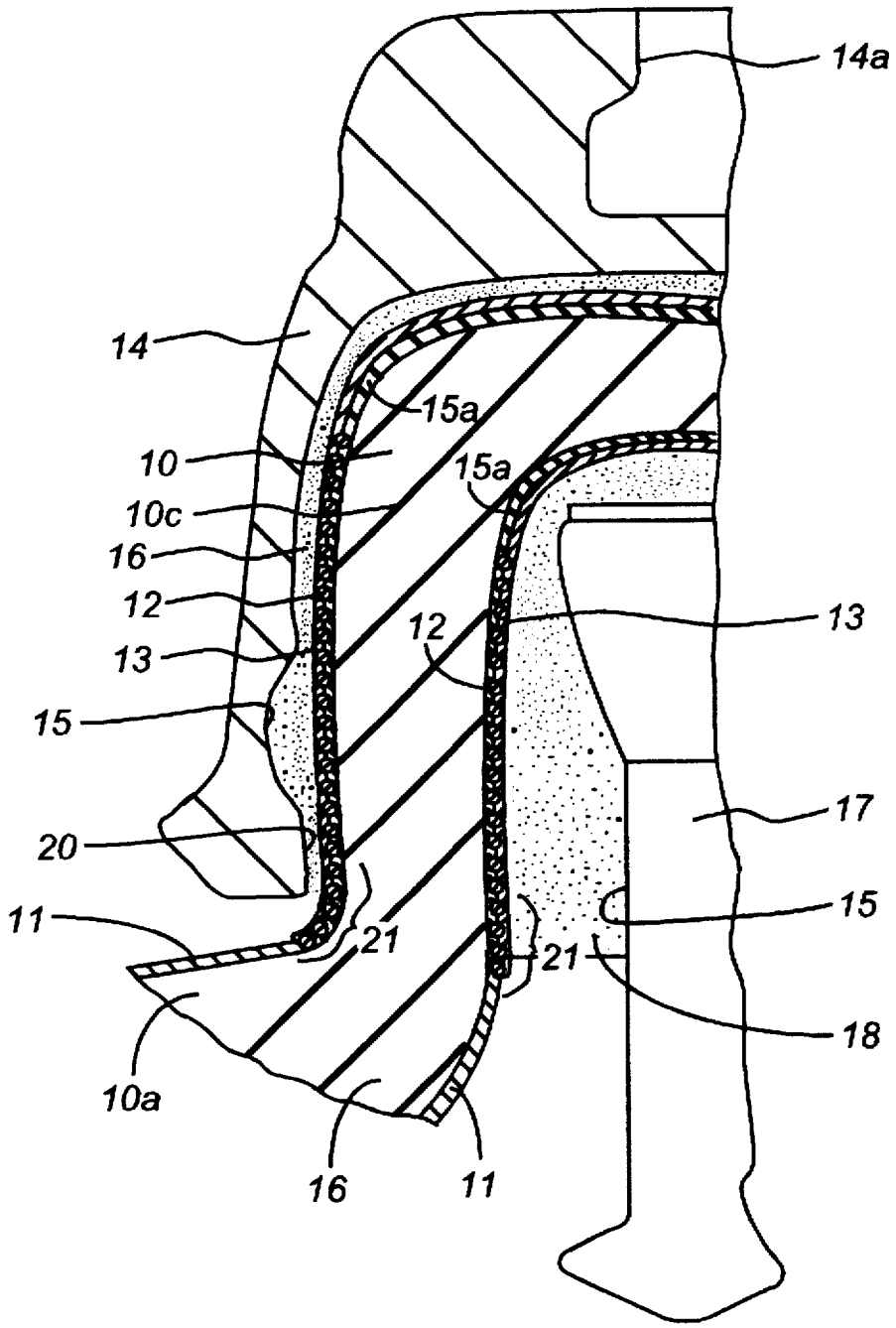
FIG. 8 is an enlarged sectional partial view of a suspension insulator as the second embodiment.

As shown in FIG. 8, an insulating glaze layer 15*a* is formed on a portion of the surface of the insulator body 10 buried in a cement material 16 by using an insulating glaze. A sand portion 12 is provided on the insulating glaze layer 15*a* at a cylindrical head 10*c* of an insulator body 10. A conductive paint layer 13 is formed on this sand portion 12 and the insulating glaze layer 15*a*, and electrically contacted with conductive grain layer 21 and the conductive glaze layer 11.

A straight portion 20 is formed at an inner peripheral surface of a lower end portion of a metal cap fitting 14 such that the straight portion extends in parallel to the head portion 10*c* of the insulator body 10 from a location where the maximum load is to be applied to the surface of the head portion 10*c* to a location near a face of the metal fitting. The conductive glaze layer 11 is formed to cover the surface of the insulator body 10 from the shed portion 10*a* to a portion opposed to the straight portion 20 of the metal cap fitting 14. The conductive glaze layer 11 on the insulator body has a surface resistivity of 20MΩ.

The conductive grain layer (conductive glaze layer) 21 is formed to cover a lower end portion of the outer peripheral surface of the head of the insulator body 10 such that the layer 21 corresponds to the straight portion 20 of the metal cap fitting 14. The surface resistivity of this layer 21 is 0.5 to 3MΩ, and its conductivity is good. Therefore, the conductive grain layer 21 mitigates the electric field at a location where current is likely to concentrate, and suppresses the occurrence of corona discharge there. The insulating glaze layer 15 is formed along an inner peripheral surface of the metal cap fitting 14.

On the other hand, an insulating glaze layer 15, a sand portion 12 and a conductive paint layer 13 are also provided at an inner peripheral surface of the head portion 10*c* of the insulator body 10, and a conductive grain layer 21 is provided at a lower portion of the inner peripheral surface of the head portion 10*c*.

The conductive structure of the insulator constructed above will be explained in detail.

Figure 7:
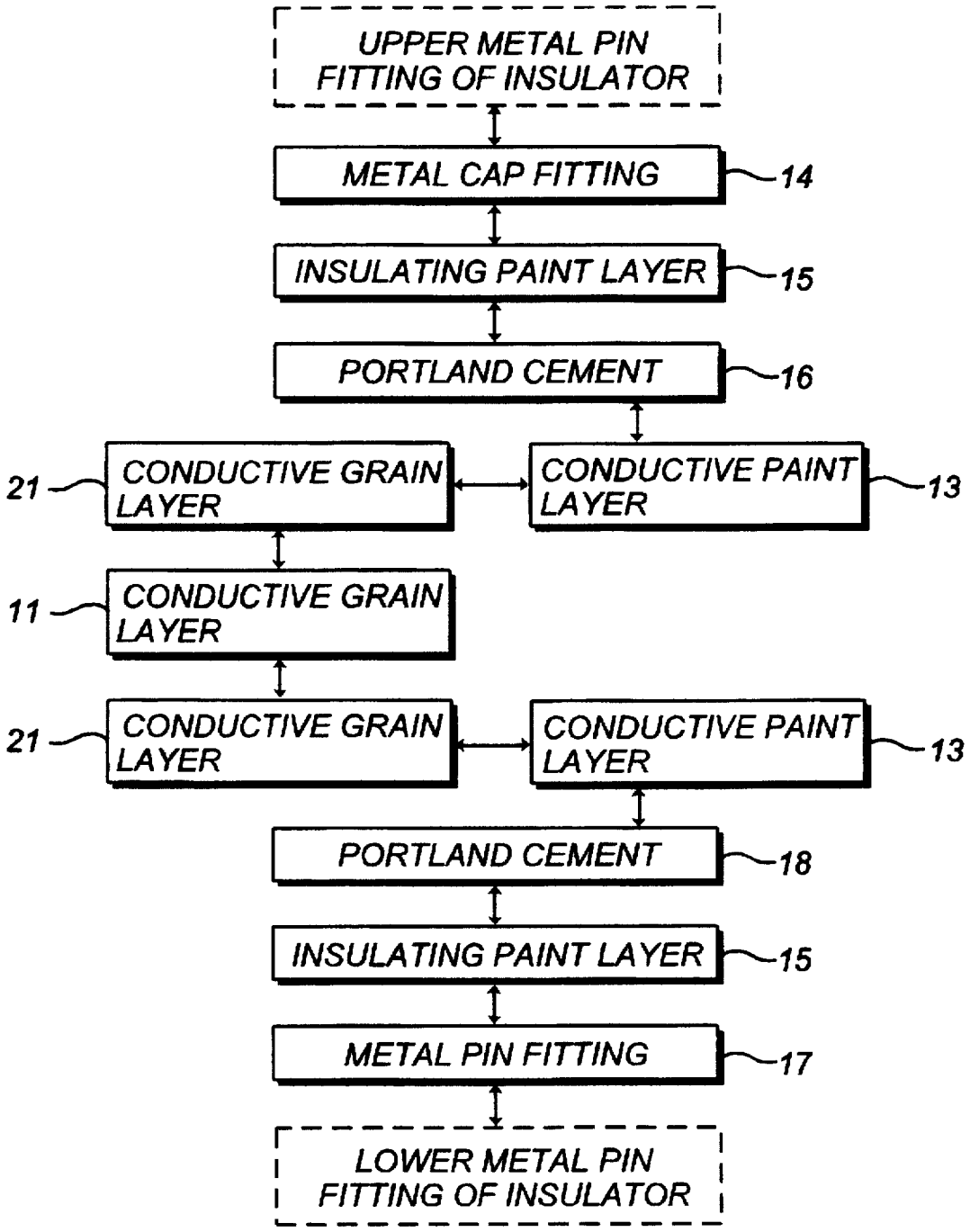
FIG. 7 is a block diagram illustrating a conductive structure of a second embodiment.

As shown in FIG. 7, for example, current from the upper metal pin fitting of the insulator flows to the free electron-conductive grain layer 21 via the free electron-conductive metal cap fitting 14, the insulating paint layer 15 effecting ion current conduction and static coupling-conductive conduction (and very partially effecting insulating film-fracturing conduction), the ion current-conductive cement 16 and the free electron-conductive paint 13. Although the insulating paint layer 15 is insulating, it allow current to flow based on ion conduction and static-coupling conduction via numerous pin holes. In the present embodiment, no corona is generated even in the case of 1 mA current passing. The intensity of current passing through the cement material under normal use is about 0.6 mA.

Current flows from the conductive grain layer 21, the conductive glaze layer 11, the conductive grain layer 21, the conductive paint layer 13, the cement material 18, the insulating paint layer 15 to the free electron-conductive metal pin fitting 17 and then for example to the lower metal cap fitting 14 of the insulator. On the other hand, current flowing from the lower metal cap fitting 14 of the insulator flows to the upper metal pin fitting 17 in the reverse direction described above.

Since the conductive paint layer 13 is arranged between the conductive grain layer 21 and the cement material 16, free electron conduction is ensured from the side of the conductive grain layer 21, so that the conductive performance of the conductive portion of the conductive grain layer 21 is enhanced.

As illustrated in FIGS. 1 and 2, the sand portion 12 may be conductive.

In the insulator according to the present embodiment, the resistance of the resistivity of the cement can be considered in the same manner as in the above first embodiment. Therefore, the applicable range is a range to satisfy X−Y/Z≦0.3MΩ. In the present embodiment, the electrode coefficient on the side of the metal cap fitting 14 is Z1=S1/L1 in which a surface area of the head portion 10*c* buried in the cement material 16 is S1 and the average distance between the inner peripheral surface of the metal cap fitting 14 and the head portion 10*c* is L1. Further, the electrode coefficient on the side of the metal cap fitting 17 is Z2=S2/L2 in which a surface area of the pin fitting 17 buried in the cement material 18 and the average distance between the pin fitting 17 and a pin-receiving recess 10*d* is L2.

The electrode coefficient, Z, of the conductive insulator according to the present embodiment is determined by either Z1 or Z2 which ever is smaller. Ordinarily, the electrode coefficient Z2 of the metal pin fitting 17 is smaller. That is, when the insulator according to the present embodiment is embodied in a suspension insulator having dimensions exhibiting a coefficient of electrode, Z, which can satisfy X=Y/Z2≦0.3MΩ, such a suspension insulator can withstand practical use.

In the present embodiment, the straight portion 20 is provided at the inner periphery of the lower end portion of the metal cap fitting 14, and the conductive glaze grain layer 21 having good conductivity is provided at each of the outer peripheral surface and the inner peripheral surface of the insulator body 10 opposed to the straight portion 20. Accordingly, the density of current at the locations of the metal fittings 14, 17, where current is likely to concentrate can be reduced, and the generation of corona discharge can be effectively prevented. In addition, since the tensile load of the insulator does not act upon the straight portion 20 of the metal cap fitting 14, reduction in the mechanical strength of the insulator can be prevented and the strength of the insulator can be maintained.

On the other hand, according to the suspension insulator, since the insulator body is made of alumina-based porcelain, the difference in coefficients of thermal expansion at 650° C. between the insulator body and the conductive glaze layer formed around the peripheral surface of the insulator body is smaller than a range of 0.1 to 0.15%. Therefore, compression stress is not applied to the surface of the insulator body with the conductive glaze layer. However, according to the present embodiment, a given compression stress is applied upon the peripheral surface of the head portion 10*c* of the insulator body 10 by the insulating glaze layer 15*a* which is formed around the peripheral surface of the insulator body. Further, a difference in coefficients of thermal expansion between the insulating glaze layer 15*a* and the insulator body being set in the range of 0.1 to 0.15%, so that the strength of the insulator can be maintained.

As regards the conductive mechanism, since the conductive paint layer 13 and the conductive grain layer 21 are provided, sufficient conduction can be attained by the conductive grain layer 21 even if the conductive paint layer 13 is degraded with the lapse of time. Further, in the case of the suspension insulator, even if the shed portion 10*a* is broken, the cap portion 10*c* remains integral with the metal cap fitting 14 and the metal pin fitting 17 so that reliability of the insulator can be ensured.

Next, a third embodiment in which the present invention is embodied in a station post insulator made of a rod-shaped insulator will be explained in detail with reference to FIG. 9.

Figure 9:
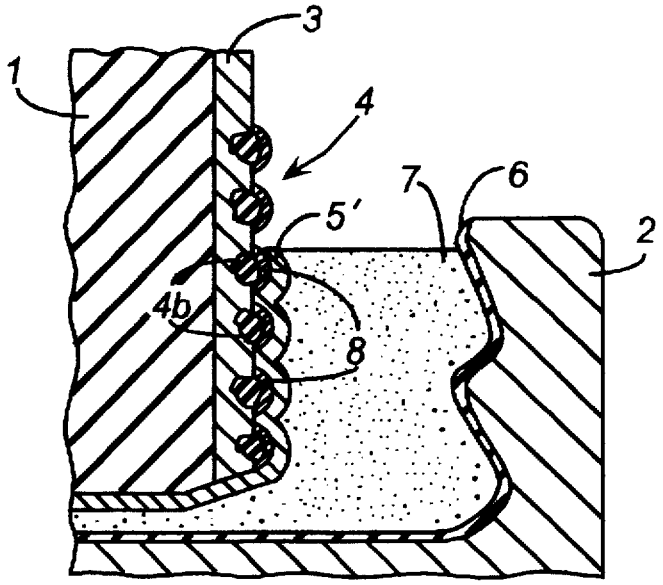
FIG. 9 is an enlarged partial sectional view of a rod-shaped insulator embodiment.

As shown in FIG. 9, a conductive glaze layer 3 is formed on a peripheral surface of an insulator body 1, and has a surface resistivity of 20MΩ. An insulating sand portion 4 is provided on the conductive glaze layer 3. A covering layer 8 is formed on the surface of a sand grains 4*b* of the sand portion 4, and has a surface resistivity of 0.5 to 3MΩ. A conductive paint layer 5' made of a conductive bituminous paint is formed on the surface of the sand portion having the covering layer 8, and has a surface resistivity of not more than 10KΩ. On the other hand, an insulating paint layer 6 is provided on an inner peripheral surface of a metal fitting 2.

In this embodiment, the conductive glaze layer 3 is provided on the entire peripheral surface of the insulator body 1, and the coefficient of thermal expansion of the conductive glaze layer 3 at 650° C. is smaller than that of a crystobalite-based body constituting the insulator body by 0.1 to 0.15%. Therefore, compression stress is applied to the insulator body 1 by the conductive glaze layer 3 depending upon the above difference in coefficient of thermal expansion so that strength of the insulator body 1 can be maintained. In addition, the current-flowing passage is ensured by the three conductive layers, i.e., the conductive glaze layer 3, the covering layer 8 on the surface of the sand grains 4*b* and the conductive paint layer 5'. As a result, the occurrence of corona discharge due to concentration of current can be prevented.

Next, a fourth embodiment in which the present invention is embodied in a station post insulator of a rod-shaped insulator will be explained with reference to FIG. 10. In this embodiment, only portions different from those in the above first embodiment will be explained.

Figure 10:
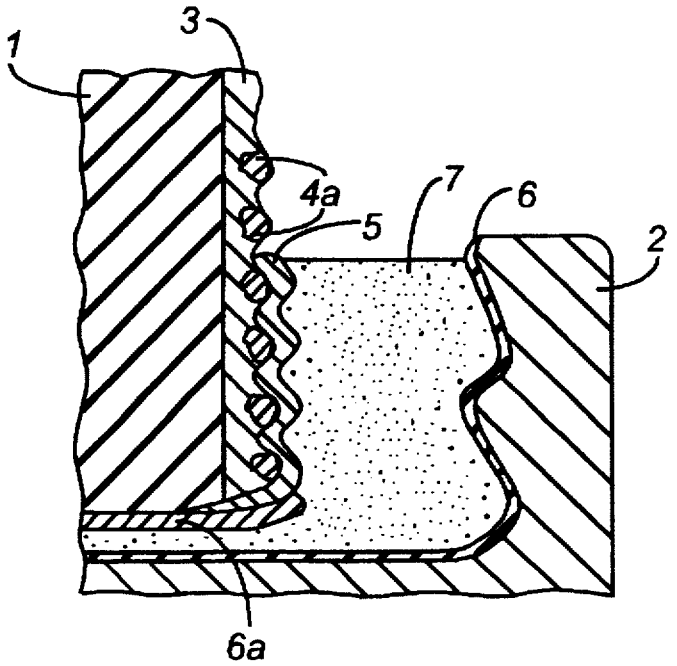
FIG. 10 is an enlarged sectional partial view of a rod-shaped insulator as a fourth embodiment.
Figure 11:
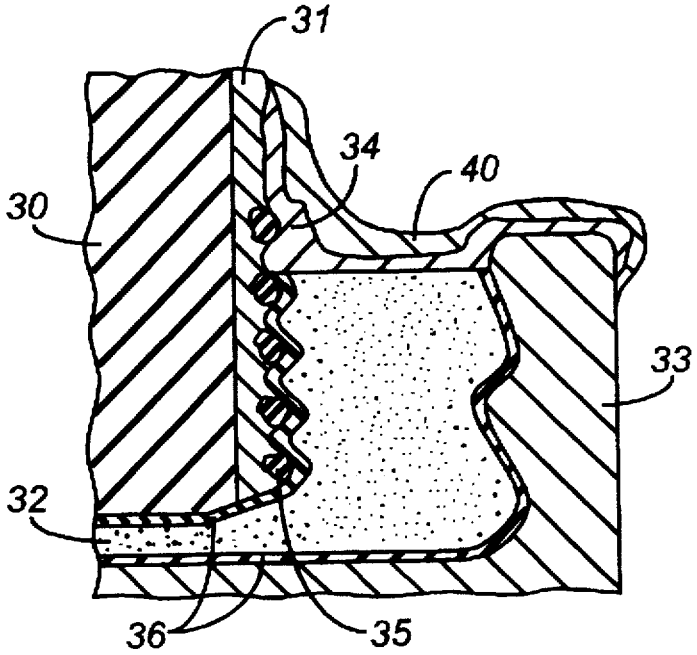
FIG. 11 PRIOR ART
FIG. 11 is a sectional partial view illustrating the an insulator obtained by the conventional metal spraying method.
Figure 12:
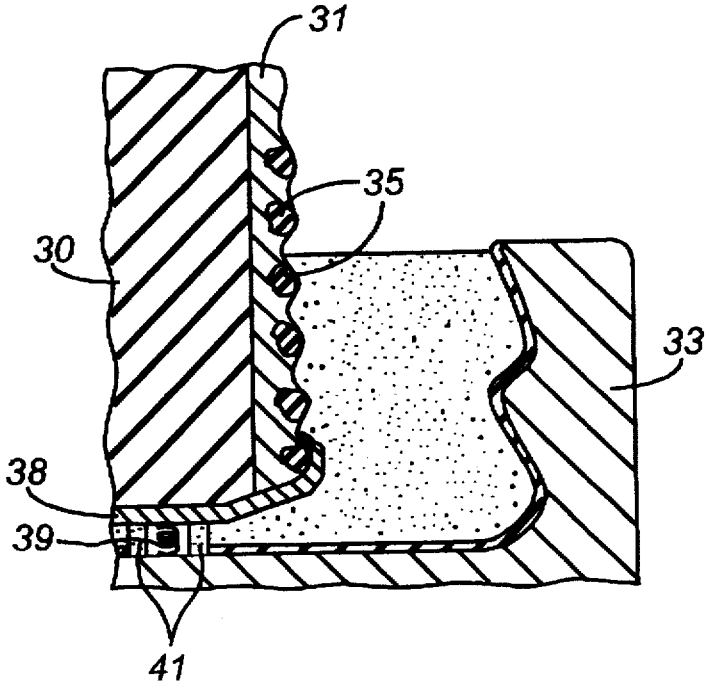
FIG. 12 PRIOR ART
FIG. 12 is a sectional partial view illustrating the an insulator obtained by the conventional metal connecting method.

As shown in FIG. 10, an insulating glaze layer 6*a* is formed, of an insulating bituminous paint,on a bottom portion (or a top portion) of an insulator body 1, and its end portion covers that of a conductive paint layer 5 provided on a peripheral surface of the insulator body 1. Therefore, no conductive paint layer 5 is provided on the bottom portion of the insulator body 1.

In this embodiment, the insulating glaze layer 6*a* is provided on the surface of the bottom portion of the insulator body 1. Therefore, the metal fitting 2 can be prevented from being corroded due to occurrence of electrolytic corrosion resulting from contact between carbon contained in the conductive paint layer 5 and the metal fitting 2 at the bottom portion of the insulator body 1. An insulating paint layer 6 is provided on the inner surface of the metal fitting 2, and has numerous pin holes present in the layer 6. Therefore, electric conduction can be ensured between the metal fitting 2 and the conductive glaze layer 5 on the surface of the insulator body 1.

The present invention can be modified as mentioned below.

(a) The present invention can be embodied as line post insulators, etc. attached on pylons for supporting power transmission lines.

(b) In the second embodiment, the conductive glaze layer 11 can be formed up to a position of the existing conductive glaze grain layer 21, while this conductive glaze grain layer 21 is omitted.

Figure 13:
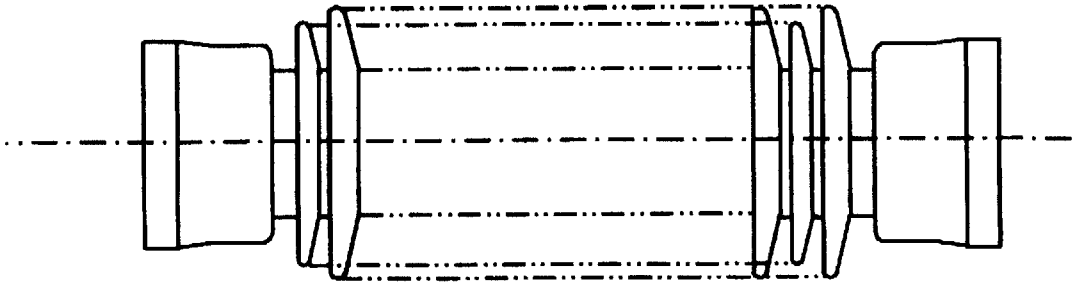
FIG. 13 is a side view of an insulator formed according to the present invention.

FIG. 13 is a side view of an insulator formed according to the present invention.

INDUSTRIAL APPLICABILITY

The insulator with conductive coating according to the present invention is suitably applicable to station posts, line posts, and rod-shaped insulators such as the long rod insulator and the suspension insulators, and is adapted to support a transmission line. The present insulator can reduce concentration of current and density of current, and effectively prevent corona discharge.

What is claimed is:

1. An insulator with conductive coating comprising:

an insulator body, a metal fitting fitted to the insulator body via a cement material such that a portion of the insulator body is buried in the cement material, said cement material conducting electricity by ionic conduction, a conductive layer having a first portion covering an exposed outer surface portion of the insulator body and a second portion provided on at least a part of a surface portion of the insulator body buried in the cement material, the second portion of the conductive layer including conductive grains, and a conductive covering film formed on and covering the second portion of the conductive layer and the conductive grains, the conductive covering film being more flexible than the second portion of the conductive layer.

2. The insulator set forth in claim 1, wherein the second portion of the conductive layer extends around a substantial entirety of a circumferential surface of the insulator body buried in the cement material.

3. The insulator set forth in claim 1, wherein the conductive film has alkaline properties.

4. The insulator set forth in claim 1, wherein an insulating film is formed on a surface of the metal fitting buried in the cement material.

5. The insulator set forth in claim 1, wherein the resistivity of the surface of the conductive layer is less than the resistivity of the conductive covering film.

6. The insulator set forth in claim 1, wherein the insulator is rod-shaped.

7. The insulator set forth in claim 1, wherein the surface resistance of the first portion of the conductive layer is 10–30MΩ, and the surface resistances of the second portion of the conductive layer and the conductive covering film are 0.5–3MΩ and not more than 10KΩ, respectively.

8. The insulator set forth in claim 1, wherein the metal fitting has a closed end portion, and an insulating layer is provided on a surface of the insulator body opposing the closed end portion of the metal fitting.

9. The insulator set forth in claim 1, wherein the insulator body comprises a head and a recess, and the metal fitting includes a cap-shaped metal component attached around the head and a pin-shaped metal component attached into the recess.

10. The insulator set forth in claim 9, wherein the head is cylindrical, the cap-shaped metal component includes a straight portion formed alone an inner periphery of a lower end portion of the cap-shaped metal component such that the straight portion extends substantially parallel to an outer peripheral portion of the insulator body, said second portion of the conductive layer comprising said conductive grain layer formed on the insulator body to oppose the straight portion.

11. The insulator set forth in claim 9, wherein the surface resistance of the first portion of the conductive layer is 15–50MΩ, and the surface resistances of the second portion of the conductive layer and the conductive covering film are 0.5–3MΩ and not more than 10KΩ, respectively.

12. The insulator set forth in claim 9, wherein said second portion of the conductive layer is formed on an insulating glaze layer provided on a surface of the head of the insulator body.

13. The insulator set forth in claim 12, wherein the conductive covering film is formed on a surface of the insulating glaze layer and a surface of the second portion of the conductive layer, the conductive covering film being in electrical contact with the second portion of the conductive layer.

14. The insulator set forth in claim 1, wherein the first portion of the conductive layer has a resistivity of about 20MΩ and the second portion of the conductive layer has a resistivity of about 0.5 to 3MΩ.

15. The insulator set forth in claim 4, wherein the the conductive grains comprise sand.

* * * * *